US010315426B2

(12) United States Patent
Teranishi et al.

(10) Patent No.: US 10,315,426 B2
(45) Date of Patent: Jun. 11, 2019

(54) METHOD FOR FORMING PATTERNED FILM AND METHOD FOR PRODUCING LIQUID EJECTION HEAD

(71) Applicant: CANON KABUSHIKI KAISHA, Tokyo (JP)

(72) Inventors: Atsushi Teranishi, Kawasaki (JP); Yoshiyuki Fukumoto, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/801,525

(22) Filed: Nov. 2, 2017

(65) Prior Publication Data

US 2018/0170054 A1 Jun. 21, 2018

(30) Foreign Application Priority Data

Dec. 15, 2016 (JP) ..... 2016-243419

(51) Int. Cl.
*B41J 2/16* (2006.01)
*B41J 2/14* (2006.01)

(52) U.S. Cl.
CPC ..... *B41J 2/164* (2013.01); *B41J 2/1603* (2013.01); *B41J 2/1623* (2013.01); *B41J 2/1628* (2013.01); *B41J 2/1629* (2013.01); *B41J 2/1631* (2013.01); *B41J 2/1632* (2013.01); *B41J 2/1642* (2013.01); *B41J 2/1643* (2013.01); *B41J 2/1645* (2013.01); *B41J 2/1646* (2013.01); *B41J 2002/14467* (2013.01); *B41J 2202/22* (2013.01)

(58) Field of Classification Search
CPC ..... B41J 2/164; B41J 2/1642; B41J 2/1643; B41J 2/1645; B41J 2/1646
See application file for complete search history.

(56) References Cited

U.S. PATENT DOCUMENTS 4,004,044 A * 1/1977 Franco ..... G03F 7/094 204/192.32
4,670,097 A * 6/1987 Abdalla ..... H05B 33/28 216/13
6,565,763 B1 * 5/2003 Asakawa ..... B82Y 10/00 216/22
8,841,152 B2 * 9/2014 Bahlke ..... H01L 51/0016 257/E21.349
2008/0182369 A1 7/2008 Jeong et al.
2009/0244203 A1 * 10/2009 Mita ..... B41J 2/14233 347/68
2012/0100676 A1 * 4/2012 Chang ..... G02F 1/134363 438/158
2013/0219702 A1 * 8/2013 Ishida ..... H05B 1/00 29/611
2014/0042552 A1 * 2/2014 Yoshimori ..... H01L 27/0617 257/392
2014/0139592 A1 * 5/2014 Horiguchi ..... B41J 2/1609 347/68
2015/0145004 A1 * 5/2015 Inoue ..... H01L 29/4236 257/192
2018/0179632 A1 * 6/2018 Teranishi ..... C23C 16/56

FOREIGN PATENT DOCUMENTS

JP 2008-187164 A 8/2008

OTHER PUBLICATIONS

Biercuj, M.J., et al., "Low-temperature atomic-layer-deposition lift-off method for microelectronic and nanoelectronic applications". Applied Physics Letters, vol. 83, No. 12, Sep. 22, 2003, 2405-2407.*
NASA Tech Briefs, "Germanium Lift-Off Masks for Thin Metal Film Patterning". Mar. 2012, pp. 17-18.*
Guo, Liang, et al., "An Effective Lift-Off Method for Patterning High-Density Gold Interconnects on an Elastomeric Substrate". NIH-PA Author Manuscript, Small. Author Manuscript; available in PMC Feb. 5, 2012, pp. 1-20.*
Vervaele, Mattias, et al., "Development of a new direct liquid injection system for nanoparticle deposition by chemical vapor deposition using nanoparticle solutions". Review of Scientific Instruments 87, 025101 (2016), pp. 1-7.*

* cited by examiner

*Primary Examiner* — Bret P Chen
(74) *Attorney, Agent, or Firm* — Venable LLP

(57) ABSTRACT

A method for forming a patterned film on a substrate includes: step of patterning a mask material on the substrate, thereby covering, with the mask material, the region except a patterned film forming region on a substrate surface on which the patterned film is to be formed; step of covering, with a protective member, at least a part of the surface of the mask material opposite to the substrate so as to allow the patterned film forming region to communicate with outside air, thereby forming a workpiece to be subjected to film formation in following step; step of forming a film on at least the patterned film forming region of the surface of the workpiece communicating with the outside air; step of releasing the protective member from the mask material; and step of removing the mask material and a part of the film on the mask material.

20 Claims, 6 Drawing Sheets

METHOD FOR FORMING PATTERNED FILM AND METHOD FOR PRODUCING LIQUID EJECTION HEAD

BACKGROUND OF THE INVENTION

Field of the Invention

The present invention relates to a method for forming a patterned film using a lift-off method. The present invention also relates to a method for producing a liquid ejection head such as an ink jet recording head.

Description of the Related Art

By forming a penetration port in a silicon substrate, various micro electro mechanical system (MEMS) devices are produced. An example thereof is a liquid ejection head that ejects a liquid. The liquid ejection head is exemplified by an ink jet recording head.

In the ink jet recording head, an energy generating element for applying energy to eject an ink is formed on a top surface of a silicon substrate. On the top surface of the substrate, an ejection port forming member is also formed, and an opening (ejection port) that ejects an ink is formed above the energy generating element. In the silicon substrate, a penetration port is formed, and through the penetration port, an ink is supplied from the back surface of the substrate to the top surface.

In recent years, the ink jet recording head is required to have higher long-term reliability, and a liquid resistant film is formed on an ink liquid contact part in some cases. The technique of patterning the liquid resistant film is exemplified by a technique called lift-off method that is a microfabrication technique for semiconductors. The lift-off method is a method for removing a mask material including a photoresist as a coating on a silicon substrate and a film formed on the mask material from the silicon substrate when a pattern or the like is formed on a plate-shaped workpiece such as a silicon substrate. A patterning method using the lift-off method is disclosed in Japanese Patent Application Laid-Open No. 2008-187164.

SUMMARY OF THE INVENTION

An aspect of the present invention provides a method for forming a patterned film on a substrate, the method including the following steps in this order a) patterning a mask material on the substrate, thereby covering, with the mask material, a region except a patterned film forming region on a substrate surface on which the patterned film is to be formed,
b) covering, with a protective member, at least a part of a surface of the mask material opposite to the substrate so as to allow the patterned film forming region to communicate with outside air, thereby forming a workpiece to be subjected to film formation in step c,
c) forming a film on at least the patterned film forming region of a surface of the workpiece communicating with the outside air,
d) releasing the protective member from the mask material, and
e) removing the mask material and a part of the film on the mask material.

Another aspect of the present invention provides a method for producing a liquid ejection head, the liquid ejection head including a substrate having a surface with an energy generating element and including a flow path forming member that defines a liquid flow path between the flow path forming member and the surface with the energy generating element of the substrate, the substrate having a penetration port, the flow path forming member having an ejection port configured to eject a liquid. The method includes a step of forming a patterned film on at least a part of a liquid flow path forming substrate surface by performing the following step a to step e in this order, a) patterning a mask material on the substrate, thereby covering, with the mask material, a region except a patterned film forming region on a substrate surface on which the patterned film is to be formed,
b) covering, with a protective member, at least a part of a surface of the mask material opposite to the substrate so as to allow the patterned film forming region to communicate with outside air, thereby forming a workpiece to be subjected to film formation in step c,
c) forming a film on at least the patterned film forming region of a surface of the workpiece communicating with the outside air,
d) releasing the protective member from the mask material, and
e) removing the mask material and a part of the film on the mask material.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1A:
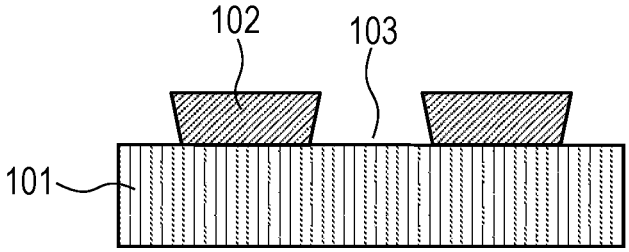
FIGS. 1A, 1B, and 1C are schematic cross sectional views showing sequential steps for forming a patterned film by a conventional lift-off method.
Figure 1B:
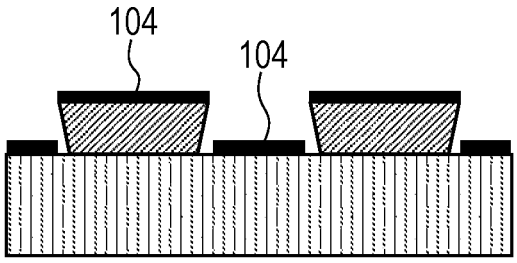
Figure 1C:
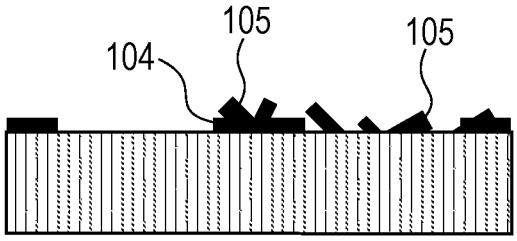

Steps of a conventional lift-off method will be described. FIGS. 1A to 1C show schematic cross sectional views for describing a film formation method using the lift-off method. On a substrate 101, a pattern (parts where a film pattern is to be formed) 103 of a mask material 102 composed of a photoresist or the like is prepared by a photolithographic method or the like (FIG. 1A). On the pattern 103, a film 104 is next deposited by a highly rectilinear film formation technique such as a physical vapor deposition (PVD)

method (FIG. 1B). Then, the mask material 102 and an unnecessary film 104 on the mask material 102 are removed (FIG. 1C). As the removal technique, a chemical removal technique such as immersion in a mask material removal liquid, a physical removal technique such as ultrasonic vibration, or a combination thereof is performed. Through the process, an intended pattern of the film 104 is formed on the substrate 101.

By the lift-off method, the film 104 removed together with the mask material 102 can be re-attached to the substrate 101, unfortunately, as shown in FIG. 1C. The film re-attached in this manner (re-attached film) 105 becomes wastes to contaminate the substrate 101. Especially in a liquid ejection head, a re-attached film 105 may clog a flow path to cause an ejection defect.

Such re-attachment of film residues as described above has been suppressed by rewashing a substrate 101 after the lift-off step (step of removing a mask material 102). However, a re-attached film 105 can be still firmly fixed onto a substrate 101 in some cases.

Meanwhile, the other patterning techniques not causing such re-attachment of a film 104 include a wet etching method and a dry etching method. These techniques, in which a film to be left is protected by a photoresist, and a film to be removed is etched, are unlikely to causes such a problem of re-attached films 105 as in the lift-off method. These techniques, however, may damage an underlayer of the film to be removed or may deposit an unnecessary altered layer on a surface to be etched.

Hence, the present invention is intended to provide a method for forming a patterned film capable of reducing a re-attached film 105 when such a lift-off method as described above is performed to form a pattern of a film 104 on a substrate 101.

The present invention is also intended to provide a method for producing a liquid ejection head using the method for forming a patterned film.

The present invention relates to a method for forming a patterned film on a substrate. The method includes steps a to e in this order. In the present specification, a substrate surface on which a patterned film is formed is called "top surface", and a substrate surface opposite thereto is called "back surface".

[Step a]

In the step, a mask material is patterned on a substrate. By the patterning, the region except a patterned film forming region on a substrate surface on which the patterned film is to be formed is covered with the mask material.

Typically, a laminar mask material is formed on a substrate. The layer is then patterned by photolithography to give a patterned mask material. The mask material may be in direct contact with the substrate, or a layer formed for any purpose (for example, an interlayer insulating film) may be present between the mask material and the substrate.

[Step b]

In the step, at least a part of the surface of the mask material opposite to the substrate (the top surface of the mask material when the substrate is placed at the lower side and the mask material is placed at the upper side) is covered with a protective member so as to allow the patterned film forming region to communicate with outside air, forming a workpiece. In other words, at least a part or all of the surface of the patterned mask material prepared in step a, opposite to the substrate is covered with a protective member. Typically, the protective member is not in contact with the substrate.

The workpiece means an object to be subjected to film formation in step c. The workpiece includes the substrate, the patterned mask material, and the protective member.

The protective member typically has a plate shape or a film shape.

Typically, the whole surface of the patterned laminar mask material opposite to the substrate is covered with the protective member. Typically, the lateral surfaces of the patterned laminar mask material (surfaces except the surface of the mask material at the substrate side and the surface of the mask material opposite to the substrate) are not covered with the protective member.

When a mask material is formed (patterned) from a photoresist and a plate-shaped or film-shaped protective member is used, the structure in which the whole top surface of the mask material is covered with the protective member and the lateral surfaces of the mask material are not covered with the protective member can be prepared.

The reason why the protective member is provided so as to allow the patterned film forming region to communicate with outside air is for supplying a raw material of a film from the outside of the workpiece to the region in step c. In addition, when a mask material has a part not covered with the protective member, the mask material can be easily removed in step e.

[Step c]

In the step, a film is formed on at least the patterned film forming region of the surface of the workpiece communicating with the outside air. The surface of the workpiece communicating with the outside air is exemplified by the outer surface of the workpiece. The outer surface of the workpiece includes the end surfaces of the substrate, and the back surface of the substrate, for example. The region communicating with the outside air also includes a region present in the workpiece and communicating with the outside air through an opening of the workpiece. The film may or may not be formed on the end surfaces of the substrate or the back surface of the substrate, for example.

As needed, before step b or between step b and step c, a step of allowing the film forming region to communicate with the outside air can be performed. For example, a material introducing path for introducing a film forming material from an end surface of a substrate to a film forming region can be formed as described in the first embodiment. Alternatively, a penetration port through a substrate or a penetration port through a protective member can be provided and used as a material introducing path as described in the third and fourth embodiments.

[Step d and Step e]

In step d, the protective member is released from the mask material. By the releasing, an unnecessary film on the protective member is also removed. In step e, the mask material and a part of the film on the mask are removed.

According to the present invention, many of the unnecessary film except the patterned film can be removed by step d performed before the lift-off step (step e). Hence, film residues generated in the lift-off step can be reduced, and the re-attachment of the film residues to the substrate can be suppressed. Especially for a liquid ejection head, unnecessary substances in a liquid flow path can be reduced, and thus the failure rate of the liquid ejection head caused by flow path clogging can be reduced.

[First Embodiment]

A first embodiment will be described as a preferred embodiment for implementing the present invention. FIGS. 2A to 2F show schematic cross sectional views of a substrate for describing steps of the first embodiment.

Figure 2A:
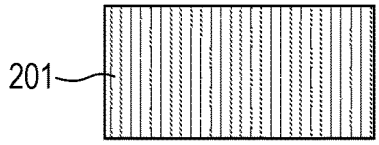
FIGS. 2A, 2B, 2C, 2D, 2E, and 2F are schematic cross sectional views of a substrate for describing sequential steps of a method for forming a patterned film of a first embodiment in the present invention.

First, a substrate 201 is prepared as shown in FIG. 2A. The substrate 201 is exemplified by a silicon substrate, a glass substrate, a silicon nitride substrate, a gallium arsenide substrate, a gallium nitride substrate, and an alumina substrate.

Figure 2B:
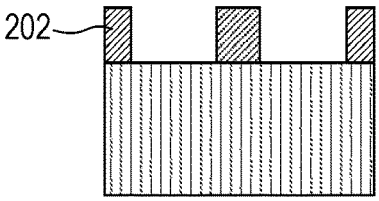

As shown in FIG. 2B, a layer of a mask material 202 is formed on a top surface of the substrate 201 and is patterned. In other words, on a top surface of the substrate 201, a mask material 202 is used to cover the region except an intended patterning area of a film 204.

The raw material of the mask material 202 is preferably a positive photoresist (photosensitive resin). This is because the mask material 202 is required to be released by a solvent in a subsequent step. The polymer included in such a raw material is exemplified by a novolac resin, a polyvinylphenol polymer, and a polyacrylic acid polymer. Other than the positive photoresist, a releasable negative photoresist can also be used. Such a photoresist is exemplified by an epoxy resin, and is preferably trade name: KMPR1000 manufactured by Nippon Kayaku Co., Ltd., which can give a releasable mask having a large thickness of 100 μm or more.

As for the shape of the mask material 202, a mask material 102 for the conventional lift-off method is required to have such a reverse tapered shape that a section parallel and closer to a substrate 101 has a smaller area as shown in FIG. 1A. This is because a combination of a reverse tapered shape and a rectilinear vapor film formation technique can prevent a film 104 from adhering to the side wall of a mask material 102 and help a solvent to infiltrate from the side wall of the mask material 102 to dissolve the mask material 102. If a mask material 102 does not have the reverse tapered shape, the side wall of the mask material 102 is unfortunately covered with a film 104, thus a solvent cannot reach to the mask material 102, and the mask material 102 is difficult to remove in some cases.

On this account, the side wall shape of a conventional mask material 102 is required to be the above reverse tapered shape or to be improved in such a way that a mask material 102 is formed from a plurality of resist layers where upper layers are wider than lower layers, for example. However, to produce such a resist having the reverse tapered shape or the like, process conditions are required to be precisely controlled, and the resist is difficult to form. In contrast, the present invention has an advantage of a mask material 202 that may have any shape in the normal direction of the surface of a substrate 201. For example, a mask material 202 having such a forward tapered shape that a section parallel and closer to a substrate 201 has a larger area can also be used. This is because a mask material 202 is not required to be dissolved from the side wall in the present invention as described later.

Figure 2C:
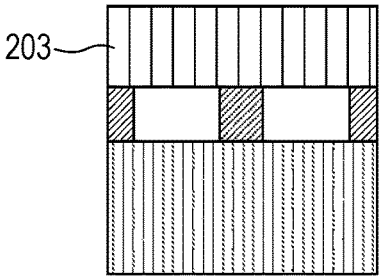

As shown in FIG. 2C, a plate-shaped or film-shaped protective member 203 is attached to the surface of the mask material 202 (the surface opposite to the substrate 201) to form a workpiece. When the protective member 203 is attached, at least a part of the mask material 202 is covered with the protective member 203. The part covered with the protective member 203 is a part on which a film 204 is not formed in a subsequent film formation step. On this account, the protective member 203 is brought into close contact with the mask material 202 to such a degree as to prevent a film 204 from forming in the part.

The protective member 203 can be a structure composed of an adhesion layer having adhesive strength and a base material. The protective member 203 is required to be removed later, and thus the protective member 203 preferably has an adhesive strength that can be reduced so as to be easily released from the mask material 202 formed on the substrate 201. Hence, the protective member 203 is exemplified by a tape including an adhesion layer made from a resin material and a base material. The tape is exemplified by a thermally releasable tape having an adhesive strength that is reduced by heat and an ultraviolet-curable tape including an adhesive having an adhesive strength that is reduced by ultraviolet irradiation.

The thickness of the tape can be appropriately selected according to a purpose or the like, but the tape is required to have such a strength as to withstand each step in which the tape is used, and thus the thickness is preferably about 20 μm to 500 μm. The raw material of the base material of the tape is composed of a resin, and the resin is exemplified by polyethylene terephthalate (PET), polyolefin, polyethylene naphthalate (PEN), polypropylene (PP), and polystyrene (PS).

The technique of bonding such a tape to a substrate 201 is exemplified by a lamination method using a tape laminator to bond a tape to a mask material 202 on a substrate 201 by roller pressure in the atmosphere or in a vacuum. Using a tape has advantages of low cost and a simple process.

Another example of the protective member 203 is a structure composed of a resin material as an adhesion layer and an inorganic material as a base material. The base material is first exemplified by a glass base material. The type of the glass is exemplified by borosilicate glass and quartz glass, which are processed at high accuracy, and inexpensive soda glass. Other examples of the base material include a silicon base material and a stainless steel (SUS) base material.

Onto such a base material, an adhesive composed of a resin is applied. The adhesive of the protective member 203 is preferably selected from materials having an adhesive strength that can be reduced for easy release in a subsequent step. The adhesive is preferably a thermoplastic liquid adhesive having an adhesive strength that is reduced by heat or an ultraviolet-curable liquid adhesive having an adhesive strength that is reduced by ultraviolet irradiation, for example. The thickness of the protective member 203 composed of a base material and an adhesive is preferably about 100 μm to 1,000 μm because the protective member 203 is required to have such a strength as to withstand each step in which the protective member 203 is used. The technique of bonding a protective member 203 including a base material made from an inorganic material to a substrate 201 is exemplified by bonding with a wafer bonder in the atmosphere or in a vacuum.

Figure 2D:
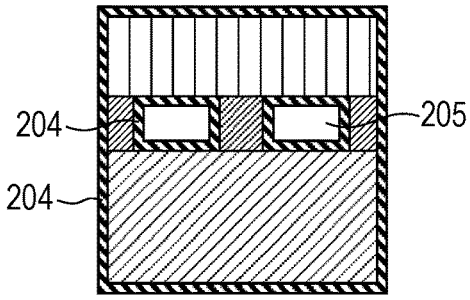

As shown in FIG. 2D, the workpiece is subjected to film formation. The material of the film 204 is exemplified by an inorganic film. The material of the inorganic film is exemplified by ceramics such as silicon oxide, silicon nitride, and silicon carbide and metals such as tantalum, gold, and nickel. Alternatively, an organic resin film 204 can also be formed and is exemplified by a parylene film and a polydimethylsiloxane film.

The technique of forming the film is exemplified by an atomic layer deposition (ALD) method. The ALD method, in which several molecule layers are deposited step by step in a high vacuum to form a film, has advantages of good adhesiveness and enabling easy film formation even in a narrow part.

Other examples of the film formation technique include a chemical vapor deposition (CVD) method, a plating method as a liquid phase film formation method, and a sputtering method and an evaporation method as a physical vapor deposition method. For example, a film formation method of heating and evaporating an organic resin in a vacuum to form a parylene film achieves good adhesiveness as with the ALD method, and thus is preferred.

Figure 2E:
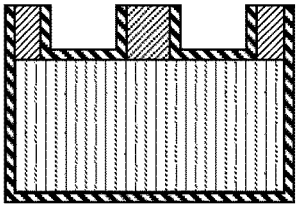
Figure 3A:
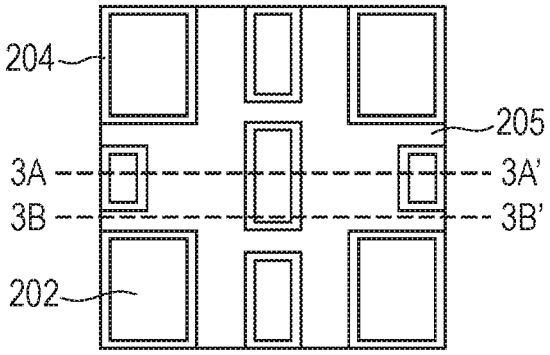
FIG. 3A is a schematic top view of the substrate in the stage of FIG. 2E.
Figure 3B:
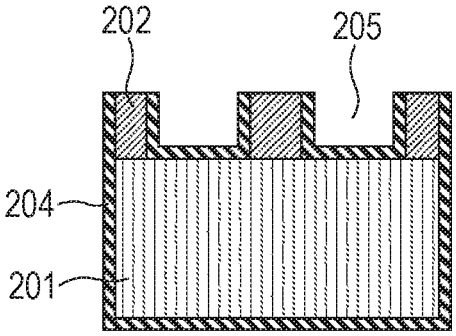
FIG. 3B is a schematic cross sectional view taken along line 3A-3A' in FIG. 3A.
Figure 3C:
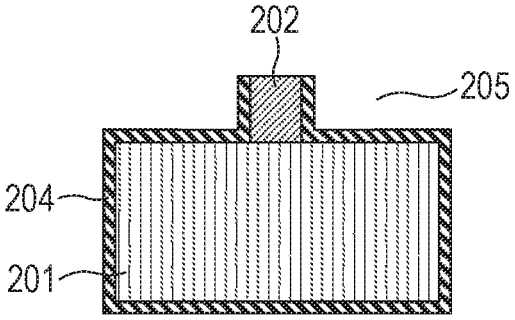
FIG. 3C is a schematic cross sectional view taken along line 3B-3B' in FIG. 3A.

FIGS. 3A to 3C show a schematic top view (FIG. 3A) of the substrate 201 (workpiece) after the formation of the film 204 and the subsequent removal of the protective member 203 (stage in FIG. 2E), a schematic cross sectional view (FIG. 3B) taken along line 3A-3A', and a schematic cross sectional view (FIG. 3C) taken along line 3B-3B'. In the present embodiment, a path (material introducing path 205) that allows a material gas or a material liquid as the raw material of a film 204 (film forming material) to enter from an end of the substrate 201 into the workpiece in the surface direction of the substrate 201 of the workpiece is formed as a part without the mask material 202 as shown in FIGS. 3A to 3C. In the present embodiment, a material introducing path 205 for introducing a film forming material from an end of the substrate 201 to at least a patterning area of a film 204 is prepared in this manner. Typically, the material introducing path 205 is a region surrounded by the patterned mask material 202, the protective member 203, and the substrate 201. For example, in such a case as shown in FIG. 2D, the side walls of the mask material 202 serve as the walls of the material introducing path 205, and the protective member 203 serves as the ceiling of the material introducing path 205.

Generally, in order to allow a film forming material to enter every nook and corner in a workpiece, the material introducing path 205 preferably has a larger width. However, for example, a film 204 formed by the ALD method has good adhesiveness, and thus the material introducing path 205 can have a smaller width. When the ALD method is used for a 2-inch substrate, typically, a material introducing path 205 from an end surface of the substrate 201 is preferably designed to have a width of 2.5 mm or more, and the mask material 202 is preferably designed to have a height of 50 μm or more.

After the film formation, the protective member 203 is released from the mask material 202 as shown in FIG. 2E. For the release, the adhesive strength of the protective member 203 is preferably reduced first. For example, when used, a thermally releasable tape is subjected to heat treatment before release from a mask material 202, and thus the adhesive strength of an adhesion layer of the tape is reduced. An ultraviolet-curable tape is subjected to ultraviolet irradiation before release from a mask material 202 for the same purpose.

The protective member 203 is released preferably after the adhesive strength is reduced. The releasing method is exemplified by a method of pulling a protective member 203 while a substrate 201 side of the workpiece is fixed by adsorption using a vacuum chuck or the like, thereby releasing the protective member 203. A specific method is exemplified by a method in which a tape for releasing a protective member is attached to the peripheral part of a protective member 203 and the releasing tape is pulled to release the protective member. The releasing tape is exemplified by a tape with glue and a thermally fusible tape that can be thermocompression-bonded to a protective member 203. Other examples include a method in which a protective member 203 is fixed by adsorption using another adsorption jig and only the protective member 203 is pulled upward from the workpiece and released.

The top surface of the mask material 202 (the surface of the laminar mask material 202 opposite to the substrate 201) is protected by the protective member 203 at the time of film formation, and thus no film is formed on the top surface of the mask material 202. Hence, after the removal of the protective member 203, a film, which is deposited on the top surface of a mask material 202 in the conventional lift-off method, is absent in the present embodiment as shown in FIG. 2E. This greatly reduces the film to be removed in a subsequent step of removing the mask material 202 by a solvent or the like, and thus the film re-attached to the substrate 201 can be reduced.

Figure 2F:
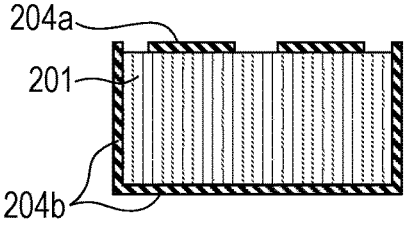

As shown in FIG. 2F, the mask material 202 and the film 204 on the mask material 202 are removed. As the removal technique, a treatment appropriate for characteristics of the mask material 202 can be performed. For example, when the mask material 202 is such a photoresist as described above, ashing by oxygen gas or immersion in an aqueous alkali solution is performed for removal. The aqueous alkali solution is exemplified by a mixture of an organic amine and a polar solvent.

In the present invention, no film can be present on the top surface of the mask material 202 after the step of releasing the protective member 203. Hence, a solvent or gas can easily reach to the mask material 202 from the top surface of the mask material 202. The embodiment therefore has an advantage over the conventional lift-off method in enabling easy removal of a mask material 202 by a solvent or an ashing gas.

In addition, a residual film that is a part of the film 204 formed on the side walls of a mask material 202 and has not been removed, that is, a burr is more certainly removed, and thus the production yield should be further improved. For example, when a method of removing a mask material 202 by immersion in an organic solvent is selected, burrs can be more certainly removed by a solvent at a higher temperature, sonication in a solvent, an appropriate rotation rate of a substrate 201 in a solvent, or the like.

The method of further reducing burrs is exemplified by a method of rewashing a substrate 201 after the above steps, by high-pressure jet washing, ultrasonic vibration washing, steam washing, supercritical carbon dioxide washing, dry ice washing, or two-fluid washing, for example.

By sequentially performing the above steps, a patterned film 204*a* can be formed on a substrate 201. A film 204*b* is also formed on the end surfaces and the back surface of the substrate 201.

[Second Embodiment]

A second embodiment will be described as a preferred embodiment for implementing the present invention. The same steps as in the first embodiment are not described basically. FIGS. 4A to 4K show steps of a method for producing a liquid ejection head to which the present invention is applicable.

Figure 4A:
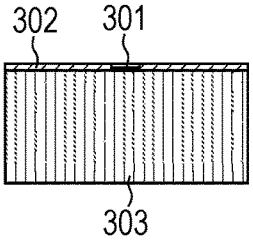
FIGS. 4A, 4B, 4C, 4D, 4E, 4F, 4G, 4H, 4I, 4J, and 4K are schematic cross sectional views showing sequential steps for producing a liquid ejection head by applying a film formation method of a second embodiment in the invention.

First, a silicon substrate 303 having the top surface on which a circuit (not shown), an energy generating element (heater) 301, and an optional interlayer insulating film 302 are formed is prepared as shown in FIG. 4A.

Figure 4B:
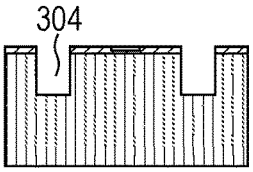

As shown in FIG. 4B, a plurality of first holes 304 (bottomed holes at this stage) functioning as individual supply ports of a liquid ejection head are formed on the top surface of the silicon substrate 303. The formation method of the first holes 304 is exemplified by dry etching and crystal anisotropic etching. The etching method is preferably dry etching. Specifically, Bosch process excellent in depth etching of silicon is preferred. The Bosch process is a technique of alternately repeating formation of a deposit film mainly containing carbon and etching by $SF_6$ gas or the like, thereby anisotropically etching silicon.

Next, by the same procedure as in the first embodiment, a mask material 305 and a protective member 306 are formed, then a film 307 is formed, and the protective member 306 and the mask material 305 are removed, thereby forming a patterned film 307*a* on the silicon substrate 303. These steps will next be described in detail.

Figure 4C:
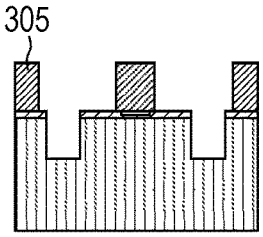

As shown in FIG. 4C, a layer of a mask material 305 is formed on the top surface of the silicon substrate 303, and then is patterned. The region except an intended patterning area of a film 307 is covered with the mask material 305. The area covered with the mask material 305 is exemplified by the area of the energy generating element 301 and the attachment area of a flow path forming member.

Figure 4D:
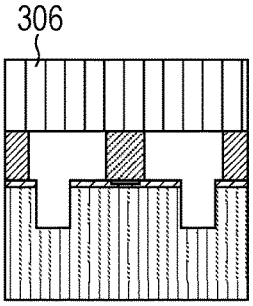

As shown in FIG. 4D, a plate-shaped or film-shaped protective member 306 is bonded to the surface of the mask material 305 (the surface opposite to the silicon substrate 303) to form a workpiece.

Figure 4E:
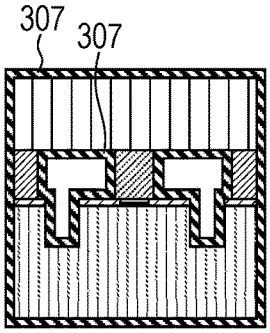

As shown in FIG. 4E, a film 307 is formed on the workpiece. The material and the formation method of the film 307 are the same as in the first embodiment. Of the materials and the formation methods described in the first embodiment, a material and a method enabling film formation in a condition of 100 to 300° C. are particularly preferred. This is because a transistor or a wiring of the energy generating element 301 is not damaged.

Figure 4F:
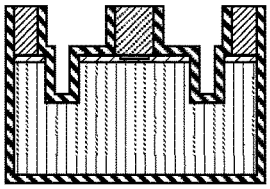
Figure 4G:
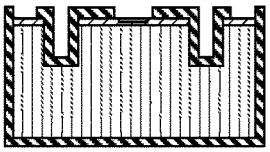

As shown in FIG. 4F, the protective member 306 is released from the mask material 305. Then, the mask material 305 and the film 307 on the mask material 305 are removed to complete patterning of the film 307 as shown in FIG. 4G.

Figure 4H:
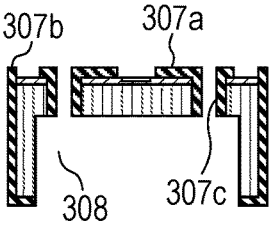

Next, the surface without the energy generating element 301 (back surface) of the silicon substrate 303 is etched to form a second hole 308 as shown in FIG. 4H. The second hole 308 reaches the first holes 304, and the first holes 304 and the second hole 308 communicate with each other to form penetration ports through the silicon substrate 303. One second hole 308 communicates with a plurality of first holes 304, and the second hole 308 functions as a common liquid chamber of a liquid ejection head. The etching method can be such a technique as described in the step in FIG. 4B. After stopping the etching, deposited substances on the inner walls of the penetration ports are removed, and then the top and back surfaces of the silicon substrate 303 and the inner walls of the penetration ports are washed.

At this stage, a patterned film 307*a* is formed on the top surface of the silicon substrate 303. In addition, a film 307*b* is formed on the end surfaces and the back surface of the silicon substrate 303, and a film 307*c* is formed on the inner walls of the first holes 304.

Figure 4I:
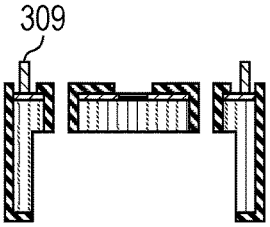

Then, a flow path forming member is formed. The flow path forming member can be formed by a method known in the field of liquid ejection head production. As shown in FIG. 4I, walls 309 of the flow path forming member are first formed. The formation method is exemplified by patterning of a dry film resist. Specifically, a dry film resist prepared by coating a film base material with a photosensitive resin is bonded to the silicon substrate 303. Then, exposure and development are performed to pattern the walls 309 of the flow path forming member.

Figure 4J:
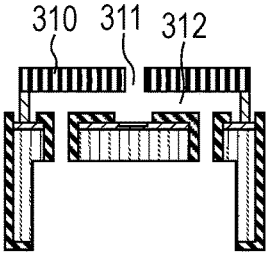
Figure 4K:
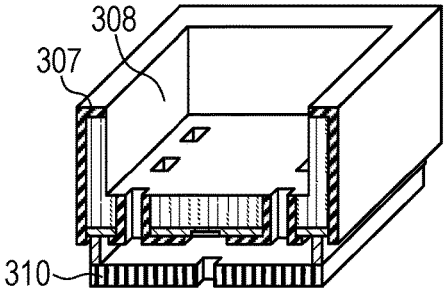

Next, a photosensitive resin is placed on the walls 309 of the flow path forming member as a cover to form a top plate 310 of the flow path forming member as shown in FIG. 4J by a similar method. Specifically, a dry film resist is bonded onto the walls 309 of the flow path forming member, and patterning is performed by exposure and development, completing a liquid ejection head. During the patterning, an ejection port 311 is formed at a position that is on the top plate 310 of the flow path forming member and corresponds to the energy generating element 301. The completed liquid ejection head is shown in FIG. 4K (in FIG. 4K, the top and bottom of the liquid ejection head in FIGS. 4A to 4J are inverted).

The present embodiment is characterized by forming the second hole 308 through the silicon substrate 303 in a later step (FIG. 4H). The embodiment thus has an advantage of maintaining the substrate strength of a silicon substrate 303 to later steps. This process can easily prevent a substrate from cracking in each step before the step to FIG. 4H. In addition, the workpiece is prevented from warping, and this facilitates proper conveyance of the workpiece.

The flow path forming member has a liquid ejection port 311 and defines a liquid flow path 312 for supplying a liquid to the ejection port 311, between the flow path forming member and the silicon substrate 303 (especially, the substrate surface with the energy generating element 301). A liquid such as an ink is supplied from the back side of the silicon substrate 303 to the second hole 308 (common liquid chamber), passes through the first holes (individual supply ports) 304 and the liquid flow path 312, and is ejected from the ejection port 311.

[Third Embodiment]

A third embodiment will be described as another preferred embodiment for implementing the present invention. FIGS. 5A to 5J show steps of a method for producing a liquid ejection head to which the present invention is applicable. The present embodiment is characterized by providing penetration ports (including first holes 304 and a second hole 308) through a silicon substrate 303 before film formation or step c. The penetration ports pass through the silicon substrate 303 and communicate with a patterned film 307*a* forming region on the silicon substrate 303.

Figure 5A:
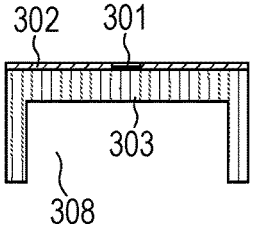
FIGS. 5A, 5B, 5C, 5D, 5E, 5F, 5G, 5H, 5I, and 5J are schematic cross sectional views showing sequential steps for producing a liquid ejection head by applying a film formation method of a third embodiment in the invention.

First, a silicon substrate 303 having a top surface on which a circuit (not shown), an energy generating element 301, and an optional interlayer insulating film 302 are formed is prepared as described in the second embodiment (FIG. 4A). On the back surface without these members of the silicon substrate 303, a second hole 308 (a bottomed hole at this stage) functioning as a common liquid chamber is formed as shown in FIG. 5A.

Figure 5B:
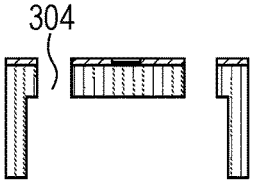
Figure 5C:
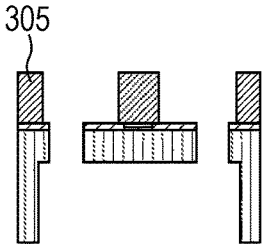
Figure 5D:
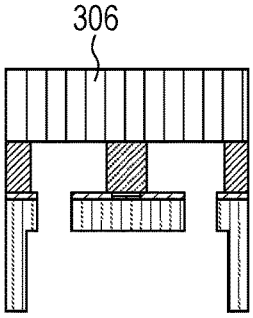

Next, first holes 304 are formed from the top surface with the circuit and the energy generating element 301 of the silicon substrate 303 as shown in FIG. 5B. The first holes 304 reach the second hole 308, and the first holes 304 and the second hole 308 communicate with each other to form penetration ports through the silicon substrate 303. In this manner, penetration ports are formed in the silicon substrate 303 before film formation. The method of forming holes, specifically the etching method is in accordance with the second embodiment. The steps shown in FIG. 5C and FIG. 5D are the same as in the second embodiment, but a material introducing path communicating with an end of the silicon substrate 303 is not necessarily formed on the surface of the silicon substrate 303.

Figure 5E:
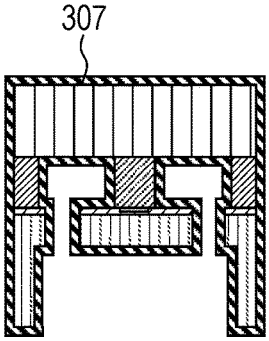

Next, film formation is performed as shown in FIG. 5E. The film 307 is formed on the back surface of the silicon substrate 303 and the end surfaces of the silicon substrate 303. Through the penetration ports, a material gas or a material liquid as the film forming material can be supplied from the back surface of the silicon substrate 303 to the top surface of the silicon substrate 303, and thus the film 307 is also formed on the inner walls of the penetration ports and the top surface of the silicon substrate 303.

In the present embodiment, the penetration ports (including the first hole 304 and the second hole 308) function as a material introducing path unlike the first and second embodiments. This structure has an advantage of enabling film formation also on the inner wall of the second hole 308, that is, on the whole inner walls of the penetration ports. For example, a liquid resistant film can be continuously formed on a liquid contact part of penetration ports through which an ejecting liquid flows. This structure can further suppress damage to a silicon substrate 303 by a liquid, and can improve the reliability of a liquid ejection head. Especially when applied to production of an ink jet recording head, this structure can suppress ink erosion in an ink flow path and the like and thus is preferred.

In the present embodiment, the length of the penetration port functioning as the material introducing path is as small as the thickness of the silicon substrate 303, and thus the embodiment has an advantage of allowing a film forming material to readily reach a film pattern region as compared with the first and second embodiments. The film formation technique can be the same as in the first embodiment. Especially when the second hole 308 or the first holes 304, on which a film is to be formed, have a high aspect ratio, the ALD method is preferred. In order to allow a film forming material gas to reach a film pattern forming region on the top surface of a silicon substrate 303 by the ALD method, typically, the second hole 308 is preferably designed to have a width of 8 μm or more, for example, for an 8-inch substrate having a thickness of 725 μm. For example, when the second hole 308 has a rectangular opening, the shortest distance between the facing hole walls can be designed to be 8 μm or more.

Figure 5F:
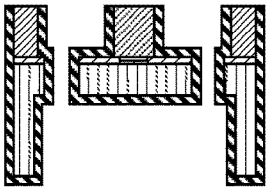
Figure 5G:
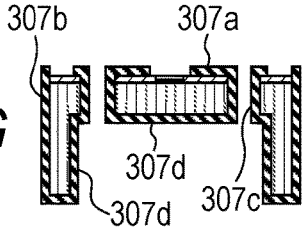

Next, the protective member 306 is removed as shown in FIG. 5F, and then the mask material 305 is removed to complete the patterning of the film 307 (FIG. 5G). In the present embodiment, in addition to a patterned film 307*a* on the top surface of the silicon substrate 303, films 307*b* on the end surfaces and the back surface of the silicon substrate 303, and films 307*c* on the inner walls of the first holes 304, films 307*d* are also formed on the inner wall of the second hole 308.

Figure 5H:
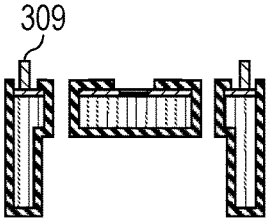
Figure 5I:
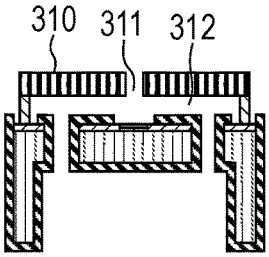
Figure 5J:
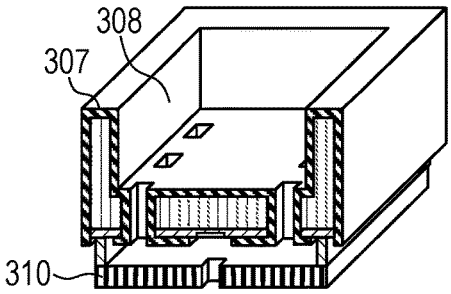

Then, a flow path forming member is formed by the same method as in the second embodiment (FIG. 5H and FIG. 5I). A liquid ejection head shown in FIG. 5K is completed.

[Fourth Embodiment]

A fourth embodiment will be described as another embodiment for implementing the present invention. FIGS. 6A to 6K show steps of a method for producing a liquid ejection head to which the present invention is applicable. The present embodiment is characterized by providing penetration ports 320 in a protective member 306.

Figure 6A:
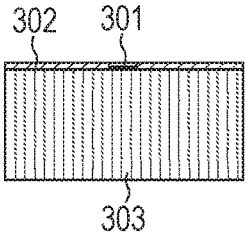
FIGS. 6A, 6B, 6C, 6D, 6E, 6F, 6G, 6H, 6I, 6J, and 6K are schematic cross sectional view showing sequential steps for producing a liquid ejection head by applying a film formation method of a fourth embodiment in the invention.
Figure 6B:
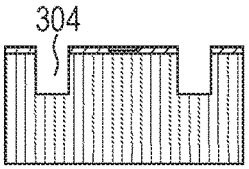
Figure 6C:
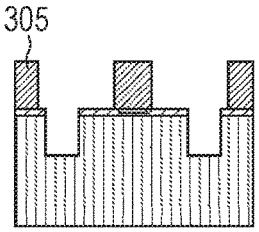

The steps in FIGS. 6A to 6C are the same as in the second embodiment (FIGS. 4A to 4C).

Figure 6D:
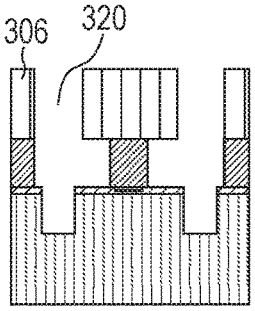

In FIG. 6D, a protective member 306 is bonded to the surface of the mask material 305 (the surface opposite to the silicon substrate 303). Here, the protective member 306 has penetration ports 320, and the penetration ports 320 function as the material introducing path for introducing a film forming material. The penetration ports 320 are provided so as to communicate with a region on which a film 307 is intended to be formed, except the back surface of the silicon substrate 303 and the end surfaces of the silicon substrate 303 (a film pattern forming region on the top surface of the silicon substrate 303 and the inner wall of the first holes 304).

The protective member 306 is exemplified by a silicon substrate having penetration ports 320 formed by etching. The other examples include a glass substrate having penetration ports 320 processed by laser or sandblast, a stainless steel plate having penetration ports 320 processed by punching, and a plastic substrate having penetration ports 320 processed with a mold.

In order to bond the protective member 306 to the mask material 305, an adhesive is applied to the surface of the protective member 306 having these penetration ports 320, for example. The adhesive is exemplified by a thermoplastic resin having an adhesive strength that is reduced by heat and an ultraviolet curable resin that is cured by ultraviolet irradiation. The method of applying the adhesive to the protective member 306 is exemplified by spin coating, slit coating, and spray coating.

A film base material coated with the adhesive may be laminated on the protective member 306 (a silicon substrate having penetration ports, for example). In such a case, an adhesion layer can be laminated on a protective member 306, and then penetration ports can be formed through the adhesion layer. The method of forming the penetration ports is exemplified by etching or asking the adhesion layer from the penetration port 320 side of the protective member 306 (the side opposite to the adhesion layer).

Figure 6E:
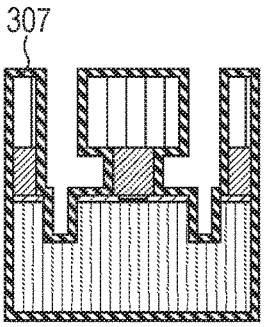

As shown in FIG. 6E, film formation is performed. At this film formation, a film 307 is formed from the protective member 306 side through the penetration ports 320. The film formation method can be the same method as in the first embodiment. In the present embodiment, it is easy to directly arrange penetration ports 320 (functioning as the material introducing path) just above the regions on which a film is intended to be formed, and a large opening shape can be designed. This is because the case of providing penetration ports 320 in a protective member 306 is unlikely to be limited by the design size of an intended device structure and thus has high degree of freedom for formation of the penetration ports 320. The present embodiment thus has an advantage of good adhesiveness of a film 307 to the surface of a silicon substrate 303 as compared with the first to third embodiments. On this account, the embodiment advantageously enables use of various film formation methods and film formation conditions and can reduce the film formation time, for example. The opening shape and the thickness of the protective member 306 can be designed in consideration of the adhesion of a film 307. A protective member 306 having a smaller thickness can reduce the length of a penetration port 320 to improve the adhesiveness of a film 307 and thus is advantageous. The thickness of the protective member 306 is typically, preferably 5 to 1,000 μm.

Figure 6F:
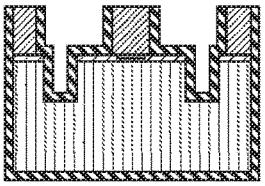
Figure 6G:
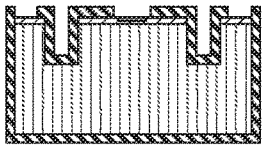

The protective member 306 is removed as shown in FIG. 6F, and then the mask material 305 is removed as shown in FIG. 6G, completing the patterning of the film 307. The removed protective member 306 can be reused after the surface is washed, and this can reduce the cost.

Figure 6H:
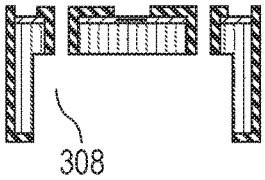
Figure 6I:
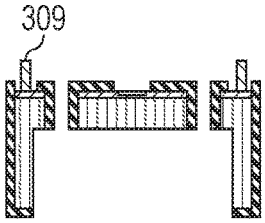
Figure 6J:
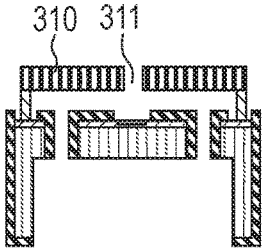
Figure 6K:
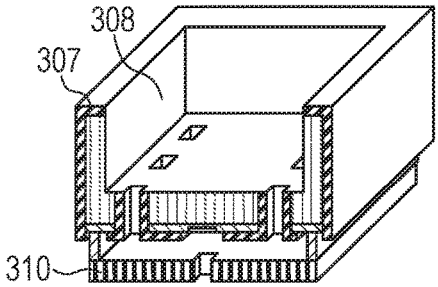

Then, by the same procedure as in the second embodiment (FIGS. 4H to 4J), a second hole 308 is formed from the back surface (FIG. 6H), and a flow path forming member is formed (FIG. 6I and FIG. 6J), completing a liquid ejection head shown in FIG. 6K.

The structures shown the first to fourth embodiments are not necessarily performed independently, and a plurality of embodiments can be appropriately combined and performed.

By any of the methods for producing a liquid ejection head described in the second to fourth embodiments, a patterned film, for example, a patterned liquid resistant film can be formed on a liquid flow path 312 formed area on the surface of a silicon substrate 303, except the region on an energy generating element 301.

By the methods for producing a liquid ejection head described in the second and fourth embodiments, a film 307*c*, for example, a liquid resistant film can be formed on a part of the inner wall of penetration ports through a silicon substrate 303, that is, on the inner walls of first holes 304 (no film is formed on the inner wall of a second hole 308). A similar film 307*b* can also be formed on the end surfaces of a silicon substrate 303 and the back surface of the silicon substrate 303.

By the method for producing a liquid ejection head described in the third embodiment, films 307*c* and 307*d*, especially a liquid resistant film can be formed on the whole inner walls of penetration ports through a silicon substrate 303 (including first holes 304 and a second hole 308). A similar film 307*b* can also be formed on the end surfaces of a silicon substrate 303 and the back surface of the silicon substrate 303.

EXAMPLES

Example 1

As Example 1, the production method described in the third embodiment (FIGS. 5A to 5J) was used to produce a liquid ejection head. By a photolithographic method, the following members were formed on an 8-inch silicon substrate (thickness: 625 μm) 303. In other words, aluminum wirings (not shown), an interlayer insulating film 302 of a silicon oxide thin film, a heater thin film pattern of tantalum nitride (energy generating element 301), and a contact pad for electrical connection to an external controller (not shown) were formed.

Onto the top surface of the silicon substrate 303, a positive photoresist (TZNR (trade name) manufactured by Tokyo Ohka Kogyo Co., Ltd.) (hereinafter, the resist is also called "TZNR resist") was applied by spinning so as to give a thickness of 10 μm to protect the top surface of the silicon substrate 303. Then, a resist was applied onto the back surface of the silicon substrate 303 by the same technique, and photolithographic process was performed to pattern the resist having a thickness of 5 μm.

The back surface of the silicon substrate 303 was etched using the resist pattern as a mask with a silicon dry etching apparatus by the Bosch process to a depth of 475 μm, and the etching was stopped. By the etching, a second hole 308 was formed. After the completion of silicon etching, the resist on the silicon substrate 303 was removed with a stripping liquid (FIG. 5A).

Then, an ultraviolet releasable tape including polyethylene terephthalate as a base material was bonded to the back surface of the silicon substrate 303 by a laminator to protect the back surface of the silicon substrate 303.

Next, the same procedure as above (patterning of the positive photoresist and the Bosch process using a silicon dry etching apparatus) was performed to etch the silicon substrate 303 from the top surface, forming first holes 304 having a depth of about 150 μm. In this manner, penetration ports (including the first holes 304 and the second hole 308) serving as an ink supply port were formed in the silicon substrate 303. Here, the opening shape on the top surface of the silicon substrate 303 was a 50×50 $\mu m^2$ square. The protective tape on the back surface was then released, and the etching mask and deposited substances by etching in the penetration ports were removed by combination of washing with a stripping liquid and oxygen plasma asking (FIG. 5B).

Next, a mask material 305 was formed on the top surface of the silicon substrate 303. A TZNR resist applied by spinning onto a polyethylene terephthalate base material was bonded to the top surface of the silicon substrate 303 by using a laminator and transferred. The resist had a thickness of 15 μm. Next, an exposure machine was used to perform pattern exposure, and the product was immersed in a developer in a developer tank, forming a pattern of the mask material 305 (FIG. 5C).

On the mask material 305, a thermally releasable tape having a thickness of 228 μm (manufactured by Mitsui Chemicals Tohcello, Inc., trade name: Icros Tape) as a protective member 306 was bonded to the mask material 305 by using a laminator with pressure, preparing a workpiece (FIG. 5D).

An atom layer deposition (ALD) film forming apparatus was used to form a metal oxide film, a $Ta_2O_5$ (tantalum pentoxide) film, having a thickness of 50 nm as an ink resistant film 307 on a region of the workpiece communicating with outside air (FIG. 5E).

Next, the workpiece was fixed onto a chuck capable of being warmed. By heating the workpiece to 50° C., the adhesive strength of the thermally releasable tape (protective member 306) was reduced, then a tape with glue as a releasing tape was attached to the peripheral part of the silicon substrate 303, and the tape as the protective member 306 was mechanically peeled off from the silicon substrate 303 (FIG. 5F).

The mask material 305 on the silicon substrate 303 and unnecessary metal oxide films (the unnecessary film on the mask material 305 and films re-attached onto the surface of the silicon substrate 303) were removed by using a running water ultrasonic cleaner nozzle (W-357-1MPD (trade name) manufactured by Honda Electronics Co., Ltd.). As the liquid for removing the mask material 305, a photoresist stripping liquid mainly containing a polyhydric alcohol (trade name: EKC1112A manufactured by DuPont) was used. The removing liquid was warmed at 40° C., then was sonicated at 1 MHz in the ultrasonic cleaner nozzle, and was sprayed to the surface of the silicon substrate 303 in conditions of a flow rate of 1.2 l/min and an output power of 10 W, thereby removing the substance to be removed (FIG. 5G).

A negative dry film resist having a thickness of 20 μm (TMMF (trade name) manufactured by Tokyo Ohka Kogyo Co., Ltd.) was bonded to the top surface of the silicon substrate 303 by using a tape laminator. Next, an exposure machine was used to perform exposure, and developing was performed to pattern walls 309 of a flow path forming member. The walls 309 of the flow path forming member were formed on the top surface of the silicon substrate 303 in a region from which the $Ta_2O_5$ film had been removed.

On the walls 309 of the flow path forming member, the dry film resist was laminated, exposed, and developed, forming a top plate 310 having an ejection port 311 of the flow path forming member. Then, the product was baked in an oven (200° C., 1 hour) (FIG. 5I).

As described above, a liquid ejection head shown in FIG. 5J was produced.

The substrate of the produced liquid ejection head was observed under an electron microscope, and film re-attachment or the like was not identified.

Example 2

As Example 2, the production method described in the fourth embodiment (FIGS. 6A to 6K) was used to produce a liquid ejection head. By a photolithographic method, the following members were formed on an 8-inch silicon substrate (thickness: 625 μm) 303. In other words, aluminum wirings (not shown), an interlayer insulating film 302 of a silicon oxide thin film, a heater thin film pattern of tantalum nitride (energy generating element 301), and a contact pad for electrical connection to an external controller (not shown) are formed (FIG. 6A).

In order to form first holes 304, a positive photoresist (TZNR (trade name) manufactured by Tokyo Ohka Kogyo Co., Ltd.) was patterned on the top surface of the silicon substrate 303, and the silicon substrate 303 was etched from the top surface to a depth of about 150 μm. After etching, the resist was removed, and the substrate was washed with a stripping liquid to remove deposited substances in the first holes 304 (FIG. 6B). The opening shape of the first hole 304 was a 50×50 $\mu m^2$ square.

On the top surface of the silicon substrate 303, a mask material 305 was formed. As with the formation of the mask material 305 in Example 1, a TZNR resist applied by spinning onto a polyethylene terephthalate base material was bonded to the top surface of the silicon substrate 303 and transferred. Pattern exposure and development were then performed in the same manner as in Example 1, forming a pattern of the mask material 305 (a thickness of 15 μm) (FIG. 6C).

Separately, a protective member 306 was prepared by the following procedure. A silicon substrate having a thickness of 400 μm was prepared, then a TZNR resist was patterned, and etching was performed by the Bosch process to form penetration ports 320. Onto a polyethylene terephthalate base material, a thermoplastic adhesive (trade name: Spaceliquid TR2 60412 manufactured by Nikka Seiko Co., Ltd.) was applied. To the silicon substrate having the penetration ports 320, the polyethylene terephthalate base material and the adhesive layer were bonded by using a laminator. Next, the silicon substrate having the penetration ports 320 was used as a mask, and the adhesive layer was etched by oxygen plasma from the surface of the silicon substrate opposite to the adhesive layer through the penetration ports 320, forming penetration ports 320. Then, only the polyethylene terephthalate base material was removed.

The protective member 306 prepared by the above procedure was bonded to the silicon substrate 303 with the mask material 305 by using a wafer bonder while heated at 140° C. (FIG. 6D). Before bonding, the protective member 306 and the silicon substrate 303 were arranged and temporarily fixed by using a bonding alignment apparatus so that the penetration ports 320 of the protective member 306 would communicate with the parts without the mask material 305 on the silicon substrate 303.

From the top surface of the protective member 306 (the surface opposite to the substrate), a metal oxide film, a $Ta_2O_5$ (tantalum pentoxide) film, having a thickness of 50 nm was formed as an ink resistant film 307 by using an ALD film forming apparatus on a region of the silicon substrate 303 communicating with outside air (FIG. 6E).

Next, the workpiece was fixed to a chuck capable of being warmed. While the workpiece was heated at 140° C., the protective member 306 was adsorbed by an adsorption jig and pulled up, thereby peeling off the protective member 306 (the silicon substrate with the penetration ports) (FIG. 6F).

Then, the adhesive of the protective member 306, the TZNR resist as the mask material 305, and the unnecessary $Ta_2O_5$ film adhering to the resist side wall were removed by using a solvent and an ultrasonic cleaner nozzle in the same manner as in Example 1 (FIG. 6G).

Then, the top surface of the silicon substrate 303 was protected by laminating a thermally releasable tape having a thickness of 228 μm (trade name: Icros Tape manufactured by Mitsui Chemicals Tohcello, Inc.). On the back surface of the silicon substrate 303, a mask is formed from a TZNR resist, and the silicon substrate 303 was processed to a depth of 475 μm by the Bosch process, forming a second hole 308. The second hole 308 communicated with the first holes 304 on the top surface of the silicon substrate 303, thereby forming penetration ports serving as an ink supply port. Then, the thermally releasable protective tape was removed (FIG. 6H).

Next, a flow path forming member was formed on the top surface of the silicon substrate 303 in the same manner as in Example 1 (FIG. 6I and FIG. 6J), and a liquid ejection head shown in FIG. 6K was produced.

The substrate of the produced liquid ejection head was observed under an electron microscope, and film re-attachment or the like was not identified.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-243419, filed Dec. 15, 2016, which is hereby incorporated by reference herein in its entirety.

What is claimed is:

1. A method for forming a patterned film on a substrate, the method comprising step a to step e in this order:

a) patterning a mask material on the substrate, thereby covering, with the mask material, a region except a patterned film forming region on a substrate surface on which the patterned film is to be formed;

b) covering, with a protective member, at least a part of a surface of the mask material opposite to the substrate so as to allow the patterned film forming region to communicate with outside air, thereby forming a workpiece to be subjected to film formation in step c;

c) forming a film on at least the patterned film forming region of a surface of the workpiece communicating with the outside air;

d) releasing the protective member from the mask material; and e) removing the mask material and a part of the film on the mask material.

2. The method according to claim 1, wherein in the step c, the film is formed by an atomic layer deposition method.

3. The method according to claim 1, wherein in the step c, the film is formed by one or a plurality of methods selected from a chemical vapor deposition method, a sputtering method, an evaporation method, and a plating method.

4. The method according to claim 1, wherein before the step c, a penetration port communicating with the patterned film forming region on the substrate is formed in the substrate.

5. The method according to claim 2, wherein before the step c, a penetration port communicating with the patterned film forming region on the substrate is formed in the substrate.

6. The method according to claim 3, wherein before the step c, a penetration port communicating with the patterned film forming region on the substrate is formed in the substrate.

7. The method according to claim 1, wherein before the step c, a penetration port communicating with the patterned film forming region on the substrate is formed in the protective member.

8. The method according to claim 2, wherein before the step c, a penetration port communicating with the patterned film forming region on the substrate is formed in the protective member.

9. The method according to claim 3, wherein before the step c, a penetration port communicating with the patterned film forming region on the substrate is formed in the protective member.

10. The method according to claim 1, wherein the mask material is a photoresist.

11. The method according to claim 2, wherein the mask material is a photoresist.

12. The method according to claim 3, wherein the mask material is a photoresist.

13. The method according to claim 1, wherein the protective member includes a base material selected from glass, silicon, stainless steel, and resin.

14. The method according to claim 2, wherein the protective member includes a base material selected from glass, silicon, stainless steel, and resin.

15. The method according to claim 3, wherein the protective member includes a base material selected from glass, silicon, stainless steel, and resin.

16. The method according to claim 1, wherein in the step e, one or a plurality of washings selected from jet washing, ultrasonic vibration washing, steam washing, dry ice washing, and two-fluid washing are performed.

17. A method for producing a liquid ejection head, the liquid ejection head including a substrate having a surface with an energy generating element and including a flow path forming member that defines a liquid flow path between the flow path forming member and the surface with the energy generating element of the substrate, the substrate having a penetration port, the flow path forming member having an ejection port configured to eject a liquid, the method comprising:

a step of forming a patterned film on at least a part of a liquid flow path forming substrate surface by performing step a to step e in this order:

a) patterning a mask material on the substrate, thereby covering, with the mask material, a region except a patterned film forming region on a substrate surface on which the patterned film is to be formed, b) covering, with a protective member, at least a part of a surface of the mask material opposite to the substrate so as to allow the patterned film forming region to communicate with outside air, thereby forming a workpiece to be subjected to film formation in step c, c) forming a film on at least the patterned film forming region of a surface of the workpiece communicating with the outside air, d) releasing the protective member from the mask material, and e) removing the mask material and a part of the film on the mask material.

18. The method according to claim 17, wherein in the step c, the film is formed on at least a part of an inner wall of the penetration port.

19. The method according to claim 18, wherein in the step c, the film is formed by an atomic layer deposition method.

20. The method according to claim 18, wherein in the step c, the film is formed by one or a plurality of methods selected from a chemical vapor deposition method, a sputtering method, an evaporation method, and a plating method.

* * * * *